US010208458B2

(12) United States Patent
Shin et al.

(10) Patent No.: US 10,208,458 B2
(45) Date of Patent: Feb. 19, 2019

(54) METHOD FOR COMPENSATING FOR FLOW RATE OF HYDRAULIC PUMP OF CONSTRUCTION MACHINE

(71) Applicant: VOLVO CONSTRUCTION EQUIPMENT AB, Eskilstuna (SE)

(72) Inventors: Hung-Ju Shin, Gyeongsangnam-do (KR); Sang-Hee Lee, Gyeongsangnam-do (KR)

(73) Assignee: Volvo Construction Equipment AB, Eskilstuna (SE)

( * ) Notice: Subject to any disclaimer, the term of this patent is extended or adjusted under 35 U.S.C. 154(b) by 72 days.

(21) Appl. No.: 15/528,760

(22) PCT Filed: Dec. 10, 2014

(86) PCT No.: PCT/KR2014/012146

§ 371 (c)(1),
(2) Date: May 22, 2017

(87) PCT Pub. No.: WO2016/093392

PCT Pub. Date: Jun. 16, 2016

(65) Prior Publication Data

US 2017/0321394 A1 Nov. 9, 2017

(51) Int. Cl.

| | |
|---|---|
| ***F15B 11/05*** | (2006.01) |
| ***E02F 9/22*** | (2006.01) |
| ***E02F 9/20*** | (2006.01) |
| ***F15B 13/042*** | (2006.01) |

(52) U.S. Cl.

CPC ..... *E02F 9/2235* (2013.01); *E02F 9/20* (2013.01); *E02F 9/22* (2013.01); *E02F 9/2285* (2013.01); *E02F 9/2296* (2013.01); *F15B 11/055* (2013.01); *F15B 13/042* (2013.01); *E02F 9/2004* (2013.01); *E02F 9/2267* (2013.01); *E02F 9/2271* (2013.01); *F15B 2211/523* (2013.01); *F15B 2211/575* (2013.01); *F15B 2211/857* (2013.01)

(58) Field of Classification Search

CPC ... E02F 9/2235; E02F 9/20; E02F 9/22; E02F 9/2285; F15B 2211/255

See application file for complete search history.

(56) References Cited

U.S. PATENT DOCUMENTS

| | | | | |
|---|---|---|---|---|
| 7,269,945 | B2 | 9/2007 | Bae | |
| 9,206,798 | B2 * | 12/2015 | Jung | E02F 9/2235 |
| 2003/0019681 | A1 | 1/2003 | Nakamura | |
| 2013/0125537 | A1 | 5/2013 | Kim | |

FOREIGN PATENT DOCUMENTS

| | | | |
|---|---|---|---|
| CA | 2888629 | A1 | 5/2014 |
| JP | H09158903 | A | 6/1997 |
| KR | 100621981 | B1 | 9/2006 |

OTHER PUBLICATIONS

International Search Report (dated Aug. 19, 2015) for corresponding Intenrational App. PCT/KR2014/012146.

* cited by examiner

*Primary Examiner* — Thomas E Lazo
*Assistant Examiner* — Daniel S Collins
(74) *Attorney, Agent, or Firm* — WRB-IP LLP

(57) ABSTRACT

A method is provided for compensating for the flow rate of a variable capacity-type hydraulic pump such that, when a manipulation lever is manipulated, a discontinuous section, which has no change in the discharge flow rate of the hydraulic pump, is eliminated.

2 Claims, 4 Drawing Sheets

[Fig. 1a]
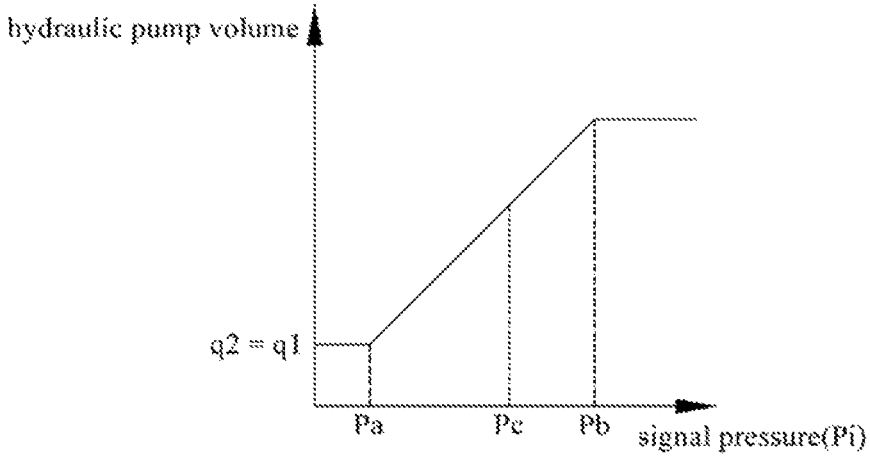
[Fig. 1b]
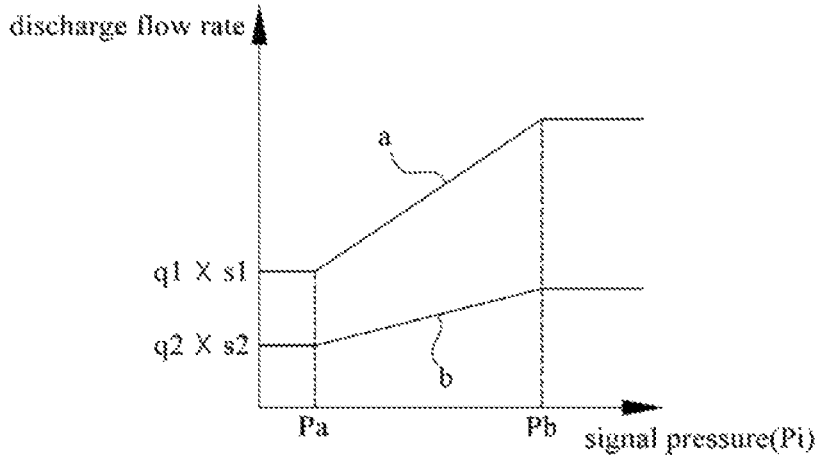
[Fig. 1c]
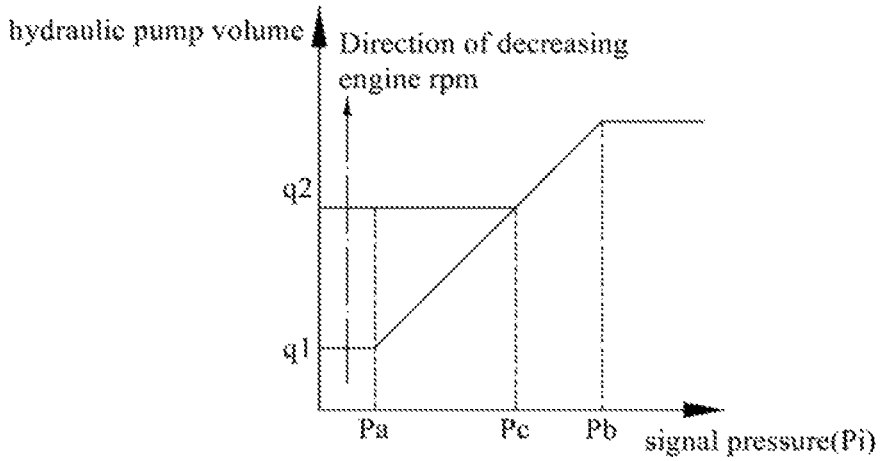

[Fig. 1d]
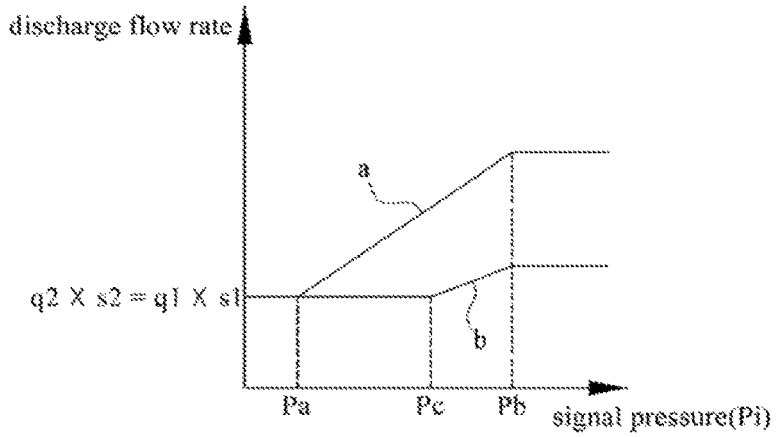
[Fig. 2]
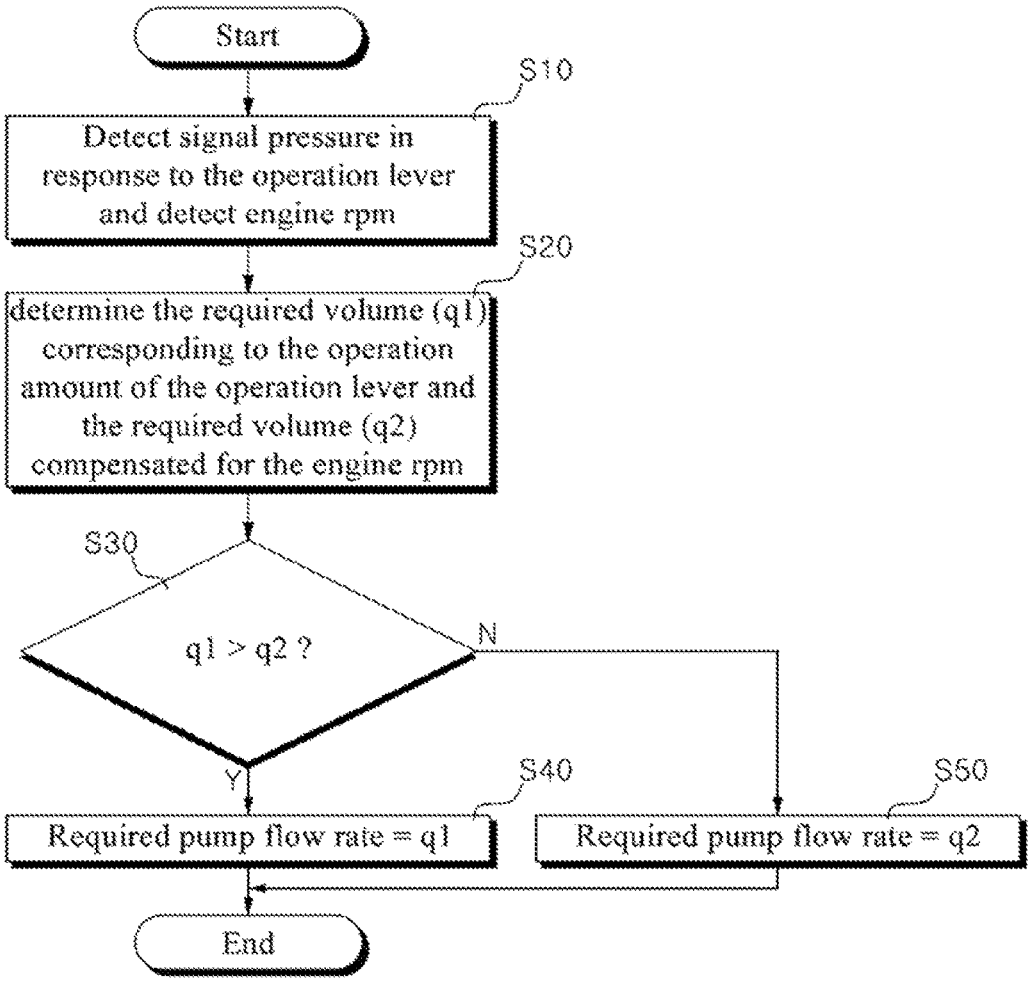

[Fig. 3a]
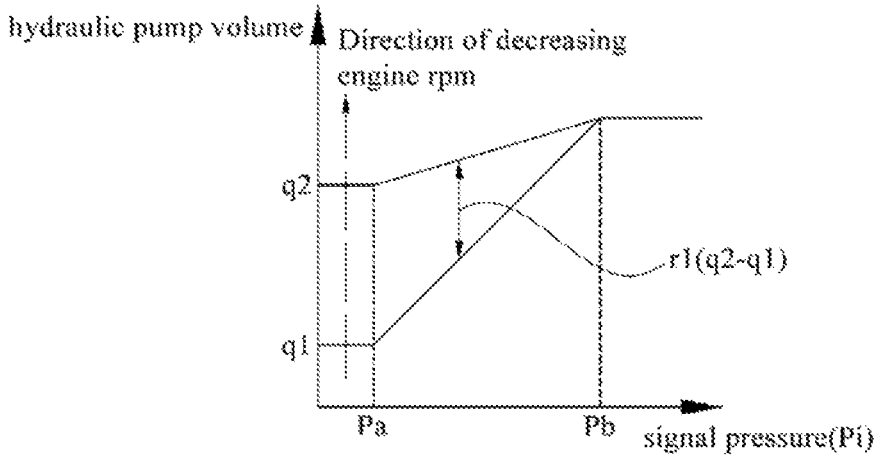
[Fig. 3b]
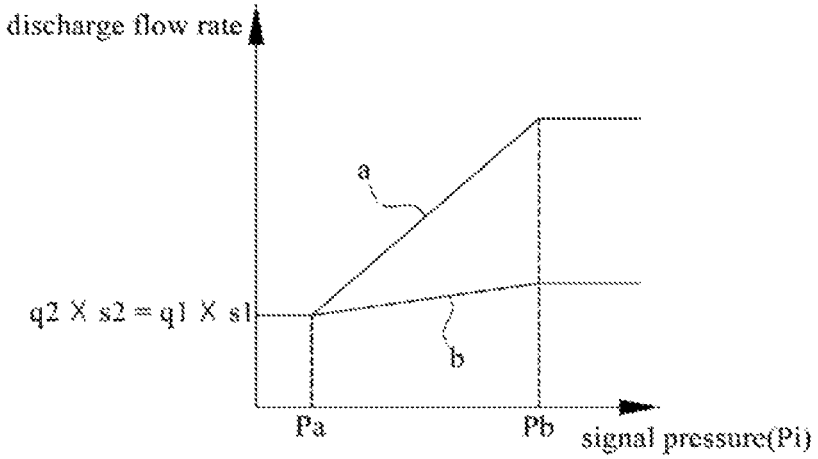
[Fig. 4]
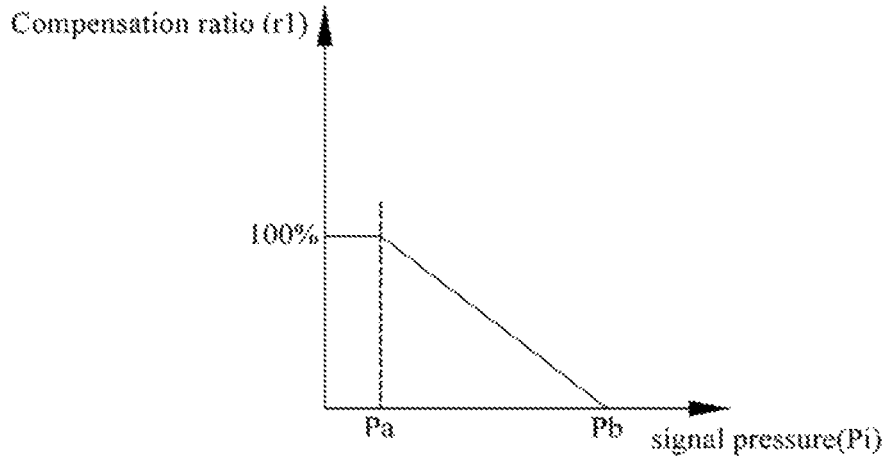

[Fig. 5]
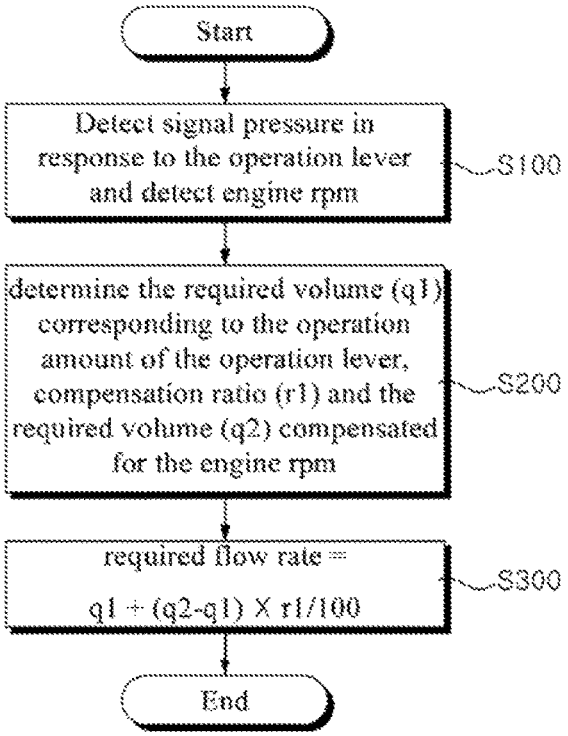
[Fig. 6]
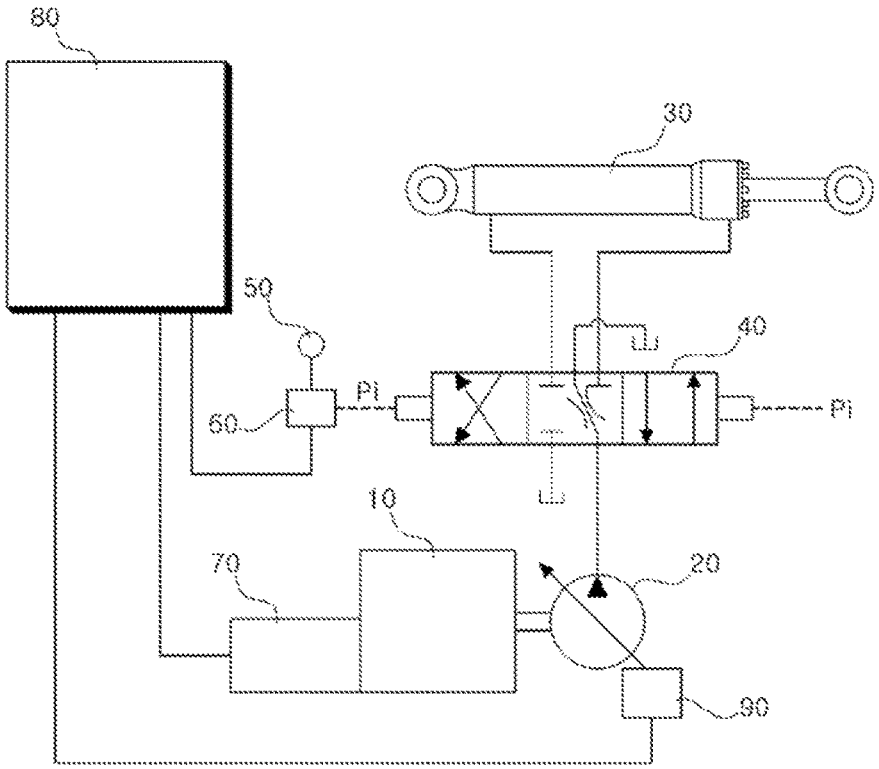

METHOD FOR COMPENSATING FOR FLOW RATE OF HYDRAULIC PUMP OF CONSTRUCTION MACHINE

BACKGROUND AND SUMMARY

The present invention relates to a method for compensating flow rate of hydraulic pump and more particularly, a method for compensating a discharge flow rate of hydraulic pump for construction machine in order to remove a dead zone in which the discharge flow rate does not change by operation of an operation lever.

FIG. 1(*a, b*) are the graphs showing a pump volume and a discharge flow rate of a hydraulic pump in response to an operation amount of an operation lever according to the conventional technology, respectively, FIG. 1(*a*)shows that a pump volume of the hydraulic pump in response to a pilot pressure (Pi) applied to the control valve by operation of the operation lever does not vary depending on an engine RPM (Revolutions Per Minute).

As shown in FIG. 1(*b*), a discharge flow rate (q1×s1) corresponding to a required pump volume (q1) in accordance with an operation amount of the operation lever, and a preset higher engine RPM (s1) represented by the graph (a) differs from a discharge flow rate (q2×s2) of the graph (b) corresponding to a required pump volume (q2) which has been compensated by taking the engine RPM into account, and a preset lower engine RPM (s2).

Accordingly, since the discharge flow rates of the graphs (a, b) are different from each other at a starting point of the operation (point of pilot pressure Pa), the initial sense of operation which is experienced by the operator when the working device like boom gets started becomes different depending on the preset engine RPM.

FIG. 1(*c, d*) are the graphs showing the pump volume and the discharge flow rate of the hydraulic pump in response to the operation amount of the operation lever according to the another conventional technology, respectively. FIG. 2 is a flow chart. Showing a method for compensating a discharge flow rate of the hydraulic pump according to the conventional technology. In accordance with the conventional technology, a method for compensating the discharge flow rate of the hydraulic pump for a construction machine, the construction machine including a variable displacement hydraulic pump (hereinafter, hydraulic pump) connected to the engine; a hydraulic actuator that drives the working device by operating a hydraulic fluid discharged from the hydraulic pump; a control valve (MCV) installed in a flow path that is connected between the hydraulic actuator and the hydraulic pump; an operation lever (RCV) outputting a signal pressure corresponding to an operation amount; a means for detecting the operation amount of the operation lever; a means for detecting an engine RPM; and a controller for controlling the control valve in response to the signal pressure corresponding to the operation amount and the detected signal corresponding to the engine RPM, the method comprises, a step of detecting the signal pressure corresponding to the operation amount of the operation lever, and the engine RPM (s10);

a step of presenting a required pump volume (q1) corresponding to the operation amount of the operation lever, and a required pump volume (q2) compensated for the engine RPM (s20);

a step of comparing the required pump volume (q1) with the required pump volume q2 (s30);

a step of controlling the hydraulic pump so that a discharge flow rate corresponds to the operation amount of the operation lever if the reauired pump volume q1 is greater than the reauired pump volume q2 (q1>q2) (s40); and, a step of controlling the hydraulic pump so that a discharge flow rate corresponds to the flow rate compensated for the engine RPM if the reauired pump volume q1 is smaller than the reauired pump volume q2 (q1<q2) (s50).

According to the conventional method for compensating a flow rate discharged from the hydraulic pump, if the pilot pressure corresponding to the operation amount of the operation lever is inputted to the control valve, the flow rate discharged from the hydraulic pump is set in such a way that, in a state where the engine RPM is low, the required pump volume (q1) corresponding to the operation amount of the operation lever is adjusted to the required pump volume (q2) compensated by the engine RPM as shown in FIG. 1(*c*).

As shown in FIG. 1(*d*), since the compensated value of the required pump volume does not depend on the pilot pressure (Pi) given by operation of the operation lever, the discharge flow rate of the hydraulic pump does not change even with of the change in the operation of the operation lever in a state where the operation is operated until pilot pressure (Pc) in a dead zone.

Then, the discharge flow rate of the hydraulic pump abruptly increases at the operation moment (the operation lever is positioned at pilot pressure Pc) of leaving the dead zone. Thus, due to the existence of the dead zone in the operation of the operation lever, the discharge flow rate increases against the operator's intention, making the operation speed of the working device fast and deteriorating the operation sensibility and the workability.

It is desirable to provide a method for compensating, a discharge flow rate of a hydraulic pump of construction equipment, in which the discharge flow rate can be controlled as the operator intends to by removing a dead zone in the operation of the operation lever.

In accordance with an aspect of the present invention, there is provided a method for compensating a discharge flow rate of a hydraulic pump for construction machine equipment including a hydraulic pump connected to an engine; a hydraulic actuator that drives the working device by operating hydraulic fluid; a control valve installed in a flow path of the hydraulic pump; an operation lever outputting the signal pressure corresponding to an operation amount; a means for detecting the operation amount of the operation lever; a means for detecting, an engine rpm; and a controller for controlling the control valve in response to the signal pressure corresponding to the operation amount and the detected signal corresponding to an engine rpm, the method comprising;

detecting the signal pressure corresponding to the operation amount of the operation lever, and the engine rpm;

determining a required discharge volume corresponding to the operation amount of the operation lever and the compensation ratio, and determining a required discharge volume that is compensated for the engine rpm, and controlling a discharge flow rate of the hydraulic pump;

wherein the discharge flow rate is derived from the sum of the required volume corresponding to the operation amount of the operation lever and the calculated volume that is obtained by multiplying the percentile compensation ratio by the difference value between the required volume corresponding to the operation amount of the operation lever and the required volume that is compensated for the engine rpm.

The compensation ratio ranges from 100% when the spool of the control valve begins to shift by the operation of the operation lever to 0% when the discharge flow rate is controlled corresponding to the operation amount, and decreases with the pilot pressure, which means that the ratio is inversely proportional to the pilot pressure.

According to the embodier rent of the present invention having the above-described configuration, a dead zone of the discharge flow rate is avoided in the operation of the operation lever for driving the working device such as excavator, allowing the discharge flow rate to be controlled at the operator's intention and thus improving the operation sensibility and the workability.

BRIEF DESCRIPTION OF THE DRAWINGS

FIG. 1(*a, b*) are the graphs showing a pump volume and a discharge flew rate of a hydraulic pump in response to an operation amount of the operation lever according to the conventional technology.

FIG. 1(*c, d*) are the graphs showing a pump volume and a discharge flow rate in response to the operation amount of the operation lever according to another conventional technology FIG. 2 is the flow chart demonstrating a method of compensating the discharge flow rate of the hydraulic pump according to the conventional technology.

FIG. 3(*a, b*) are the graphs showing a pump volume and a discharge flow rate of a hydraulic pump in response to an operation amount of the operation lever according to the embodiment of the present invention.

FIG. 4 is the graph showing the functional relation between a volume compensation ratio and a pilot pressure by the operation of the operation lever in a method for compensating a discharge flow rate of a hydraulic pump according to the embodiment of the present invention.

FIG. 5 is the flow chart showing the method for compensating the discharge flow rate of the hydraulic pump according to the embodiment of the present invention.

FIG. 6 is the hydraulic circuit used for the method of compensating the discharge flow rate of the hydraulic pump according to the embodiment of the present invention.

EXPLANATION OF REFERENCE NUMERALS FOR MAIN PARTS IN THE DRAWING

10; engine
20; variable displacement hydraulic pump
30; hydraulic actuator
40; control valve (MCV)
50; operation lever (RCV)
60; means for detecting the operation amount of the operation lever
70; means for detecting engine RPM
80; controller
90; regulator

DETAILED DESCRIPTION

Hereinafter, a method for compensating a discharge flow rate of a hydraulic pump for construction equipment according to a preferred embodiment, of the present invention will be described in detail with reference to the accompanying drawings.

FIG. 3(*a, b*) are the graphs showing a pump volume and a discharge flow rate in response to an operation amount of the operation lever according to the embodiment of the present invention. FIG. 4 is the graph showing the functional relation between a volume compensation ratio and a pilot pressure by the operation of the operation lever in the method for compensating the discharge flow rate of the hydraulic pump according to the embodiment of the present invention. FIG. 5 is the flow chart showing the method for compensating the discharge flow rate of the hydraulic pump according to the embodiment of the present invention. FIG. 6 is the hydraulic circuit used for the method of compensating the discharge flow rate of the hydraulic pump according to the embodiment of the present invention.

Referring to FIG. 3(*a, b*) to FIG. 6, the method for compensating the discharge flow rate of the hydraulic pump for construction machine according to an embodiment of the present invention is applied for the construction machine comprising;

a variable displacement hydraulic pump (20) connected to the engine (10); a hydraulic actuator (30) that drives the working device by operating the hydraulic fluid; a control valve (MCV) (40) installed in the path of the hydraulic pump (20); an operation lever (RCV) (50) outputting the signal pressure corresponding to the operation amount; a means (60) for detecting the operation amount of the operation lever (50); a means (70) for detecting the engine rpm; and a controller (80) for controlling: the control valve (40) in response to the signal pressure corresponding to the operation amount and the detected signal corresponding to the engine rpm, which are generally used in the technical field of the present invention. Therefore, the detailed explanations of those elements will be omitted.

The method for compensating the flow rate of the hydraulic pump of the construction equipment according; to an embodiment of the present invention comprises;

a step of detecting the signal pressure corresponding to the operation amount of the operation lever (50), and the engine rpm (S100);

a step of determining a required discharge volume (q1 ) corresponding to the operation amount of the operation lever (50) and a compensation ratio (r1), and determining a required discharge volume (q2) that is compensated for the engine rpm (S200); and, a step of inputting the control signal to the regulator (90) in order to control the hydraulic pump (20) so that the discharge flow rate is derived from the sum ($=q1+(q2-q1)\times r1/100$) of the required volume (41) corresponding to the operation amount of the operation lever and the calculated discharge volume ($(q2-q1)\times r1/100$) that is obtained by multiplying a percentile of the compensation ratio (r1) by the difference value (q2−q1) between the required volume (q1) corresponding to the operation amount of the operation lever and the required volume (q2) that is compensated for the engine rpm (S300).

The compensation ratio ranges from 100% (Pa) when the spool of the control valve (40) begins to shift by the operation of the operation lever (50) to 0% (Pb) when the discharge flow rate is controlled corresponding to the operation amount, and can be controlled so that the ratio value is inversely proportional to the pilot pressure and thus decreasing with the pilot pressure.

According to the aforementioned method, in a step of S100, the operation signal (Pi) corresponding to the operation amount of the operation lever (50) is detected by the means (60) for detecting the operation amount of the operation lever, and the signal for the engine rpm is detected by the means (70) for detecting the engine rpm. The signals detected by the means (60) for detecting the operation a Count of the operation lever and the means (70) for detecting engine rpm are inputted to the controller (80).

As in S200, the controller (80) determines the required discharge volume (q1) corresponding to the operation amount of the operation lever (50), the compensation ratio (r1), and the required discharge volume (q2) that is compensated for the engine rpm.

As shown in FIG. 3(*a*), the compensation ratio (r1) of the hydraulic pump (20) is determined in the range from 100% (Pa) when the spool of the control valve (40) begins to shift by the operation of the operation lever (50) to 0% (Pb) when the discharge flow rate is controlled corresponding to the operation amount of the operation lever (50).

As shown in FIG. 4, the compensation ratio (r1) is controlled so that the ratio value is inversely proportional to the pilot pressure and thus decreasing with the pilot pressure applied by the operation lever (50).

As in 300, the control signal is inputted to the regulator (90) in order to control the hydraulic pump (20) so that the discharge flow rate is derived from the sum (=q1+(q2−q1)×r1/100) of the required discharge volume (q1) corresponding to the operation amount of the operation lever and the calculated volume ((q2−q1)×r1/100) that is obtained by multiplying the percentile compensation ratio (r1) by the difference value (q2−q1) between the required discharge volume (q1) corresponding to the operation amount of the operation lever and the required discharge volume (q2) that is compensated for the engine rpm.

Accordingly, as shown in FIG. 3(*b*), the discharge flow rate (hydraulic pump volume×engine rpm) of the hydraulic pump is controlled by the graph (a) which shows (q1×s1) of the required discharge volume (q1) corresponding to the operation amount of the operation lever (50) multiplied by the arbitrary higher engine rpm (s1), and the graph (h which shows (q2×s2) of the required discharge volume (q2) compensated for the engine rpm multiplied by the arbitrary lower engine rpm (s2).

As a result, as shown in the graph (b) of FIG. 3(*b*), the spool of the control valve (40) gradually begins to shift from the point (Pa) where the pilot pressure (Pa) corresponding to the operation amount of the operation lever (50) is inputted to the control valve (40). Thus, it can prevent the working device from being operated abruptly when the working device is operated by the operation lever (50).

Although the present invention has been described with reference to the preferred embodiment in the attached figures, it is to be understood that various equivalent modifications and variations of the embodiments can be made by a person having an ordinary skill in the art without departing from the spirit and scope of the present invention as recited in the claims.

According to the present invention having the above-described configuration, since the discharge flow rate of the hydraulic pump can be controlled so as not to increase abruptly by eliminating the flat range of flow rate when the working device such as the boom of the excavator is operated by the operation lever, it brings the effect of improving the operability.

What is claimed is:

1. A method for compensating a discharge flow rate of a hydraulic pump for a construction machine, the construction machine including a hydraulic pump connected to an engine;

a hydraulic actuator that drives the working device by operating hydraulic fluid;

a control valve installed in a flow path of the hydraulic pump;

an operation lever outputting a signal pressure corresponding to an operation amount;

means for detecting the operation amount of the operation lever;

means for detecting an engine rpm; and a controller for controlling the control valve in response to the signal pressure corresponding to the operation amount and a detected signal corresponding to an engine rpm, the method comprising;

detecting the signal pressure corresponding to the operation amount of the operation lever, and the engine rpm;

determining a required discharge volume corresponding to the operation amount of the operation lever and a compensation ratio, and determining a required discharge volume that compensates for the engine rpm, and controlling a discharge flow rate of the hydraulic pump, wherein the controlling step includes controlling the hydraulic pump so that the discharge flow rate derived from a sum of a required volume corresponding to the operation amount of the operation lever and a calculated volume that is obtained by multiplying a percentile compensation ratio by a difference value between the required volume corresponding to the operation amount of the operation lever and the required volume that compensates for the engine rpm.

2. The method of claim 1, wherein, the compensation ratio ranges from 100% when a spool of the control valve begins to shift by operation of the operation lever to 0% when the discharge flow rate is controlled corresponding to the operation amount, and is controlled so that the ratio value is inversely proportional to a pilot pressure and thus decreasing with the pilot pressure applied by the operation lever.

* * * * *